US010407632B1

(12) United States Patent
Fruchey et al.

(10) Patent No.: US 10,407,632 B1
(45) Date of Patent: Sep. 10, 2019

(54) LOW SULFUR MARINE FUEL COMPOSITIONS

(71) Applicant: ExxonMobil Research and Engineering Company, Annandale, NJ (US)

(72) Inventors: Erin R. Fruchey, Philadelphia, PA (US); Scott K. Berkhous, Center Valley, PA (US); Kenneth C. H. Kar, Philadelphia, PA (US); Sheryl B. Rubin-Pitel, Newton, PA (US); Aditya S. Shetkar, Houston, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 16/200,858

(22) Filed: Nov. 27, 2018

(51) Int. Cl.
*C10L 1/08* (2006.01)
*C10L 10/16* (2006.01)

(52) U.S. Cl.
CPC ..... *C10L 1/08* (2013.01); *C10L 10/16* (2013.01); *C10G 2300/1059* (2013.01); *C10G 2300/301* (2013.01); *C10G 2400/06* (2013.01); *C10L 2200/0438* (2013.01); *C10L 2270/026* (2013.01)

(58) Field of Classification Search
CPC ..... C10L 2270/026; C10G 2300/1059; C10G 2400/06; C10G 2300/301
See application file for complete search history.

(56) References Cited

U.S. PATENT DOCUMENTS

| | | | | |
|---|---|---|---|---|
| 3,522,169 | A | 7/1970 | Ireland | |
| 4,601,303 | A | 7/1986 | Jensen | |
| 4,677,567 | A | 6/1987 | Grosser et al. | |
| 5,917,101 | A | 6/1999 | Munoz | |
| 6,222,082 | B1 | 4/2001 | Hubbard et al. | |
| 6,235,068 | B1 | 5/2001 | Moreton | |
| 6,291,732 | B2 | 9/2001 | Hubbard et al. | |
| 8,987,537 | B1 * | 3/2015 | Droubi | C10L 1/04 585/14 |
| 8,999,011 | B2 * | 4/2015 | Stern | C10G 45/02 44/300 |
| 9,057,035 | B1 * | 6/2015 | Kraus | C10L 1/04 |
| 9,109,176 | B2 * | 8/2015 | Stern | C10G 45/02 |
| 2003/0094400 | A1 * | 5/2003 | Levy | C10G 67/12 208/222 |
| 2004/0111957 | A1 | 6/2004 | Filipppini et al. | |
| 2005/0288537 | A1 | 12/2005 | Maund et al. | |
| 2006/0047446 | A1 | 3/2006 | Naiman et al. | |
| 2007/0027046 | A1 | 2/2007 | Friend et al. | |

(Continued)

FOREIGN PATENT DOCUMENTS

| | | | |
|---|---|---|---|
| CN | 103602347 | A | 2/2014 |
| EP | 1570032 | B1 | 2/2011 |

(Continued)

*Primary Examiner* — Ellen M McAvoy
(74) *Attorney, Agent, or Firm* — Anthony G. Boone

(57) ABSTRACT

Heavy hydrotreated gas oil compositions are provided, along with marine fuel oil compositions and marine gas oil compositions that include a substantial portion of a hydrotreated heavy atmospheric gas oil. The hydrotreated heavy atmospheric gas oil can correspond to a gas oil with a relatively low viscosity and an elevated paraffin content in a narrow boiling range which results in a relatively high cloud point and/or pour point.

20 Claims, 3 Drawing Sheets

| Blend | Density (g/mL) | KV50 (cSt) | V50 | Sulfur (ppm m/m) | BMCI | TE | BMCI-TE | Asphaltenes wt% | MCR wt% | CCAI | Cetane | Oxygen wt% |
|---|---|---|---|---|---|---|---|---|---|---|---|---|
| 1-A | 0.9245 | 40.17 | 26.16 | 6579.92 | 48.62 | 22.94 | 25.68 | 0.06 | 2.90 | 814.22 | 21.43 | 0.31 |
| 2-A | 0.9229 | 34.96 | 25.61 | 6849.04 | 48.41 | 22.96 | 25.45 | 0.60 | 3.10 | 814.86 | 19.29 | 0.33 |
| 3-A | 0.8910 | 12.07 | 20.74 | 2221.82 | 39.51 | 22.00 | 17.50 | 0.02 | 0.80 | 803.49 | 47.82 | 0.09 |
| 4-A | 0.8703 | 5.73 | 16.28 | 1399.52 | 34.85 | 21.16 | 13.69 | 0.01 | 0.50 | 801.63 | 50.15 | 0.05 |
| 1-B | 0.9072 | 37.38 | 25.88 | 5561.84 | 41.14 | 22.94 | 18.21 | 0.06 | 2.90 | 798.09 | 26.30 | 0.60 |
| 2-B | 0.9048 | 32.60 | 25.33 | 5782.48 | 40.60 | 22.96 | 17.65 | 0.06 | 3.00 | 798.00 | 24.42 | 0.63 |
| 3-B | 0.8863 | 11.96 | 20.69 | 1930.94 | 37.47 | 22.00 | 15.47 | 0.02 | 0.80 | 799.04 | 49.04 | 0.17 |
| 4-B | 0.8677 | 5.71 | 16.26 | 1229.84 | 33.69 | 21.16 | 12.53 | 0.01 | 0.50 | 799.07 | 50.85 | 0.10 |
| 1-C | 0.9091 | 12.67 | 20.99 | 5709.68 | 49.49 | 22.91 | 26.58 | 0.04 | 2.00 | 820.57 | 26.32 | 0.85 |
| 2-C | 0.9068 | 10.98 | 20.23 | 5937.36 | 49.32 | 22.94 | 26.39 | 0.04 | 2.10 | 821.49 | 24.43 | 0.89 |
| 3-C | 0.8863 | 11.96 | 20.69 | 1930.94 | 37.47 | 22.00 | 15.47 | 0.02 | 0.80 | 799.04 | 49.04 | 0.17 |
| 4-C | 0.8680 | 5.09 | 15.47 | 1254.48 | 35.03 | 20.51 | 14.52 | 0.01 | 0.30 | 802.68 | 50.86 | 0.14 |

(56) References Cited

U.S. PATENT DOCUMENTS

| | | | | |
|---|---|---|---|---|
| 2008/0083157 | A1 | 4/2008 | Chao | |
| 2008/0210611 | A1 | 9/2008 | Tabb et al. | |
| 2011/0277377 | A1 | 11/2011 | Novak et al. | |
| 2012/0000824 | A1* | 1/2012 | Dougherty | C10G 3/50 208/210 |
| 2012/0053377 | A1* | 3/2012 | Mizan | C10G 3/45 585/240 |
| 2012/0080357 | A1 | 4/2012 | Novak et al. | |
| 2012/0246999 | A1* | 10/2012 | Stern | C10G 45/02 44/300 |
| 2013/0014431 | A1 | 1/2013 | Jin et al. | |
| 2013/0019522 | A1 | 1/2013 | Eaton et al. | |
| 2013/0081977 | A1 | 4/2013 | Woo et al. | |
| 2013/0081978 | A1 | 4/2013 | Brown et al. | |
| 2013/0098322 | A1 | 4/2013 | Tonti et al. | |
| 2013/0180164 | A1 | 7/2013 | Wolf | |
| 2013/0340323 | A1 | 12/2013 | Stern et al. | |
| 2014/0291200 | A1 | 10/2014 | Weiss et al. | |
| 2015/0072298 | A1 | 3/2015 | Kohler et al. | |
| 2015/0240174 | A1 | 8/2015 | Kraus et al. | |
| 2015/0337225 | A1 | 11/2015 | Droubi et al. | |
| 2015/0337226 | A1 | 11/2015 | Droubi et al. | |
| 2015/0353851 | A1* | 12/2015 | Buchanan | C10L 1/08 208/15 |
| 2016/0122662 | A1* | 5/2016 | Weiss | C10G 55/04 208/89 |
| 2016/0160139 | A1* | 6/2016 | Robinson | C10G 45/08 208/15 |

FOREIGN PATENT DOCUMENTS

| | | | |
|---|---|---|---|
| FR | 3011004 | A1 | 3/2015 |
| JP | 62132997 | A | 6/1987 |
| JP | 8157839 | A | 6/1996 |
| JP | 8259965 | A | 10/1996 |
| JP | 10130666 | A | 5/1998 |
| JP | 11021568 | A | 1/1999 |
| JP | 2000186286 | A | 7/2000 |
| JP | 2001158890 | A | 6/2001 |
| JP | 2001200275 | A | 7/2001 |
| JP | 2005343917 | A | 12/2005 |
| JP | 2005343919 | A | 12/2005 |
| JP | 2006037075 | A | 2/2006 |
| JP | 2007204764 | A | 8/2007 |
| JP | 2007308569 | A | 11/2007 |
| JP | 2008120972 | A | 5/2008 |
| JP | 2009096855 | A | 5/2009 |
| JP | 2012012460 | A | 1/2012 |
| JP | 2012092253 | A | 5/2012 |
| JP | 2013053320 | A | 3/2013 |
| JP | 2014028977 | A | 2/2014 |
| JP | 2014189619 | A | 10/2014 |
| JP | 2015059220 | A | 3/2015 |
| KR | 2002003777 | A | 1/2002 |
| RU | 2074232 | C1 | 2/1997 |
| SG | 122780 | A1 | 6/2006 |
| WO | 9744414 | A1 | 11/1997 |
| WO | 200794171 | A1 | 8/2007 |
| WO | 200874704 | A1 | 6/2008 |
| WO | 200901314 | A1 | 12/2008 |
| WO | 2014096703 | A1 | 6/2014 |
| WO | 2014191004 | A2 | 12/2014 |
| WO | 201620144 | A1 | 2/2016 |

* cited by examiner

| Blend | Density (g/mL) | KV50 (cSt) | V50 | Sulfur (ppm m/m) | BMCI | TE | BMCI-TE | Asphaltenes wt% | MCR wt% | CCAI | Cetane | Oxygen wt% |
|---|---|---|---|---|---|---|---|---|---|---|---|---|
| **1-A** | 0.9245 | 40.17 | 26.16 | 6579.92 | 48.62 | 22.94 | 25.68 | 0.06 | 2.90 | 814.22 | 21.43 | 0.31 |
| **2-A** | 0.9229 | 34.96 | 25.61 | 6849.04 | 48.41 | 22.96 | 25.45 | 0.60 | 3.10 | 814.86 | 19.29 | 0.33 |
| **3-A** | 0.8910 | 12.07 | 20.74 | 2221.82 | 39.51 | 22.00 | 17.50 | 0.02 | 0.80 | 803.49 | 47.82 | 0.09 |
| **4-A** | 0.8703 | 5.73 | 16.28 | 1399.52 | 34.85 | 21.16 | 13.69 | 0.01 | 0.50 | 801.63 | 50.15 | 0.05 |
| **1-B** | 0.9072 | 37.38 | 25.88 | 5561.84 | 41.14 | 22.94 | 18.21 | 0.06 | 2.90 | 798.09 | 26.30 | 0.60 |
| **2-B** | 0.9048 | 32.60 | 25.33 | 5782.48 | 40.60 | 22.96 | 17.65 | 0.06 | 3.00 | 798.00 | 24.42 | 0.63 |
| **3-B** | 0.8863 | 11.96 | 20.69 | 1930.94 | 37.47 | 22.00 | 15.47 | 0.02 | 0.80 | 799.04 | 49.04 | 0.17 |
| **4-B** | 0.8677 | 5.71 | 16.26 | 1229.84 | 33.69 | 21.16 | 12.53 | 0.01 | 0.50 | 799.07 | 50.85 | 0.10 |
| **1-C** | 0.9091 | 12.67 | 20.99 | 5709.68 | 49.49 | 22.91 | 26.58 | 0.04 | 2.00 | 820.57 | 26.32 | 0.85 |
| **2-C** | 0.9068 | 10.98 | 20.23 | 5937.36 | 49.32 | 22.94 | 26.39 | 0.04 | 2.10 | 821.49 | 24.43 | 0.89 |
| **3-C** | 0.8863 | 11.96 | 20.69 | 1930.94 | 37.47 | 22.00 | 15.47 | 0.02 | 0.80 | 799.04 | 49.04 | 0.17 |
| **4-C** | 0.8680 | 5.09 | 15.47 | 1254.48 | 35.03 | 20.51 | 14.52 | 0.01 | 0.30 | 802.68 | 50.86 | 0.14 |

FIG. 1

| Properties | HHAGO 1 | HHAGO 2w | Distillate 1 (NSB) | Distillate 2 (NCR) | HCGO | MGO |
|---|---|---|---|---|---|---|
| | | | | | | |
| Density @15°C (D4052) (kg/m$^3$) | 875.8 | | 776.4 | 950.7 | 861.9 | 849.9 |
| Distillation (D86) (°C) | | | | | | |
| IBP | 315.6 | | 157.2 | 201.6 | 227.7 | 197.1 |
| T10 | 329.8 | | 159.1 | 207.6 | 267.8 | 238.9 |
| T50 | 356.6 | | 161.5 | 224.9 | 324.1 | 307.8 |
| T90 | 388.7 | | 167.9 | 311.8 | 373.7 | 369.0 |
| T95 | 398.7 | | 171.2 | 335.4 | 386.4 | 384.3 |
| FBP | 408.1 | | 185.4 | 368.9 | 395.4 | 396.0 |
| Pour Point (D97) (°C) | 18 | | < -60 | -45 | 6 | 3 |
| Cloud Point (D5771) (°C) | 23 | | < -60 | -24 | 10 | 8 |
| Sulfur (D2622) (wt%) | 0.189 | | 0.071 | < 0.0003 | 0.0003 | 0.034 |
| KV @40°C (D445) (mm$^2$/s) | 11.74 | | 0.8461 | 1.9 | 6.393 | 4.647 |
| Cetane Index (D4737) | 62.2 | | 39.6 | 23.2 | 55.5 | 55.3 |
| Flash Point (D6450) (°C) | --- | | 39.1 | 82.1 | --- | --- |
| | | | | | | |

FIG. 2

| | | | MGO 1 | MGO 2 | MGO 3 | Conventional MGO | DMA ISO 8217 |
|---|---|---|---|---|---|---|---|
| Viscosity (at 40 °C) | ISO 3104 | $mm^2/s$ | 7.234 | 9.723 | 3.726 | 3.726 | 2.0 - 6.0 |
| Viscosity (at 40 °C) | ASTM D445 | $mm^2/s$ | 6.314 | 9.449 | 3.503 | 4.647 | - |
| Viscosity (at 20 °C) | ASTM D445 | $mm^2/s$ | 12.43 | - | 5.525 | 8.72 | - |
| Viscosity (at 10 °C) | ASTM D445 | $mm^2/s$ | - | 23.32 | 7.467 | 11.42 | - |
| Density (at 15 °C) | ISO 12185 / ISO 3675[a] | g/mL | 0.8669 | 0.8722 | 0.8457 | 0.847 | 0.890 (max) |
| Sulfur | ISO 8754 | wt % | 0.130 | 0.120 | 0.045 | 0.045 | 0.10 |
| Cloud Point | D5771 | °C | 19.0 | 18.0 | 5.0 | 8.0 | Report |
| Pour Point | D97 | °C | 18.0 | 18.0 | -6.0 | 3.0 | 9.0 |
| Bromine Number | D1159 | g $Br_2$/100 g | 0.47 | 0.46 | 0.49 | 0.25 | - |
| Cetane Index | ISO 4264 | - | 53.1 | 58.5 | 52.4 | 57.4 | 40 (min) |
| Flash Point | ISO 2719 | °C | 75.0 | 121.5 | 71.0 | 89.5 | 60 (min) |
| Hydrogen Sulfide Content | IP 570 | mg/kg | <0.40 | <0.40 | <0.40 | <0.40 | 2.00 (max) |
| Acid Number | D664-A | mg KOH/g | <0.10 | <0.10 | <0.10 | <0.10 | 0.5 (max) |
| Carbon Residue (on 10% bottom) | ISO 10370 | %(m/m) | <0.10 | <0.10 | <0.10 | <0.10 | 0.3 (max) |

FIG. 3

LOW SULFUR MARINE FUEL COMPOSITIONS

FIELD

This invention relates generally to a hydrotreated atmospheric gas oil fraction, and methods for making low sulfur marine bunker fuels using the hydrotreated atmospheric gas oil fraction.

BACKGROUND

As promulgated by the International Maritime Organization (IMO), issued as Revised MARPOL Annex VI, marine fuels will be capped globally with increasingly more stringent requirements on sulfur content. In addition, individual countries and regions are beginning to restrict sulfur level used in ships in regions known as Emission Control Areas, or ECAs.

Those regulations specify, inter alia, a 1.0 wt % sulfur content on ECA Fuels (effective July 2010) for residual or distillate fuels, a 3.5 wt % sulfur content cap (effective January 2012), which can impact about 15% of the current residual fuel supply, a 0.1 wt % sulfur content on ECA Fuels (effective January 2015), relating mainly to hydrotreated middle distillate fuel, and a 0.5 wt % sulfur content cap (circa 2020-2025), centered mainly on distillate fuel or distillate/residual fuel mixtures. It is noted that this latter 0.5 wt % sulfur content cap corresponds to a global regulation that can potentially affect all non-ECA fuels unless an alternative mitigation method is in place, such as an on-board scrubber. When the ECA sulfur limits and sulfur cap drops, various reactions may take place to supply low sulfur fuels.

The fuels used for larger ships in global shipping are typically marine bunker fuels. Bunker fuels are advantageous since they are less costly than other fuels; however, they are typically composed of cracked and/or resid fuels and hence have higher sulfur levels. Such cracked and/or resid fuels are typically not hydrotreated or only minimally hydrotreated prior to incorporation into the bunker fuel. Instead of attempting to hydrotreat the cracked and/or resid fuels to meet a desired sulfur specification, the lower sulfur specifications for marine vessels can be conventionally accomplished by blending the cracked and/or resid fuels with distillates. While blending with distillate fuels can be effective for reducing sulfur levels, such low sulfur distillate fuels typically trade at a high cost premium for a variety of reasons, not the least of which is the utility in a variety of transport applications employing compression ignition engines. Conventionally, distillate fuels are produced at low sulfur levels, typically significantly below the sulfur levels specified in the IMO regulations.

It would be advantageous to develop alternative sources of blendstock for blending with cracked and/or resid fuels to provide lower cost alternatives when forming marine fuel oils with a sulfur content of 0.5 wt % or less. Additionally or alternately, it would be advantageous to develop alternative sources of blendstock to provide lower cost alternatives when forming marine gas oils.

SUMMARY

In various aspects, a hydrotreated atmospheric gas oil composition is provided. The composition can include a T10 distillation point of 300° C. or more, a T90 distillation point of 440° C. or less, a sulfur content of 0.03 wt % to 0.6 wt %, a $S_{BN}$ of 40 or less, a pour point of 15° C. or more, a difference between the pour point and a cloud point being 10° C. or less, and a kinematic viscosity at 40° C. of 10.5 cSt to 16 cSt.

BRIEF DESCRIPTION OF THE FIGURES

FIG. 1 shows properties of various fuel oil blends that include a heavy hydrotreated gas oil.

FIG. 2 shows properties of several potential blending components for forming a marine gas oil.

FIG. 3 shows properties of various blended marine gas oils.

DETAILED DESCRIPTION

All numerical values within the detailed description and the claims herein are modified by "about" or "approximately" the indicated value, and take into account experimental error and variations that would be expected by a person having ordinary skill in the art.

In various aspects, marine fuel oil compositions are provided that have sulfur contents of 0.5 wt % or less, where the fuel compositions include a substantial portion of a hydrotreated heavy atmospheric gas oil. The hydrotreated heavy atmospheric gas oil can correspond to a gas oil with a relatively low viscosity and an elevated paraffin content in a narrow boiling range which results in a relatively high cloud point and/or pour point. This can make the hydrotreated heavy atmospheric gas oil difficult to use directly as a fuel oil, as heating the gas oil to temperatures above the cloud point can potentially reduce the viscosity to below a desirable level for use as a fuel oil in typical marine engines. On the other hand, the viscosity and the pour point of the hydrotreated heavy atmospheric gas oil can be too high for use as a marine gas oil.

Although the hydrotreated heavy atmospheric gas oil may not meet one or more desired properties for various types of marine fuels, the combination of properties for the hydrotreated heavy atmospheric gas oil, in conjunction with a relatively low sulfur content, can make such a gas oil beneficial for blending with a variety of other types of fractions to form low sulfur marine fuels (fuel oils or gas oils) with a sulfur content of 0.5 wt % or less, such as a sulfur content of 0.1 wt % to 0.5 wt %. Such other blend fractions can include cracked and/or resid fractions, conventional marine gas oil fraction, and other distillate fractions. In some aspects, the heavy hydrotreated atmospheric gas oil can be used in place of using an automotive diesel fuel as blend component. The resulting compositions can correspond to low sulfur fuel oils under ISO 8217.

Additionally or alternately, marine distillate fuel compositions (such as marine gas oils) are also provided, where the marine distillate fuel compositions have sulfur contents of 0.5 wt % or less, such as 0.05 wt % to 0.6 wt %, or 0.1 wt % to 0.6 wt %, or 0.05 wt % to 0.5 wt %, or 0.1 wt % to 0.5 wt %. The marine distillate fuel compositions can be made in part by blending the hydrotreated heavy atmospheric gas oil with other distillate fractions and/or heavy naphtha fractions. The other distillate fractions and/or heavy naphtha fractions can be used to reduce the pour point and/or cloud point of the marine gas oil. In some aspects, the resulting marine gas oil can correspond to a marine gas oil having properties that satisfy the flash point, cetane index, and kinematic viscosity at 40° C. requirements of a DMA or DMB gas oil under ISO 8217, even though 60 wt % or more of the blend components in the resulting marine gas oil do not satisfy such requirements, or 70 wt % or more.

Additionally or alternately, in aspects where the hydrotreated heavy atmospheric gas oil is blended with one or more distillate fractions and/or heavy naphtha fractions, the resulting blend can have sufficient solubility to allow for addition of additives for cold flow improvement, such as pour point and/or cold filter plugging point additives. By contrast, such additives are not soluble in sufficient amount to be suitable for use in the hydrotreated heavy atmospheric gas oil alone.

Optionally, one or more additional hydrotreated or non-hydrotreated resid or cracked fractions can also be included in the blend to form the marine fuel composition. Optionally, one or more additional hydrotreated distillate fractions can be included in the blend to form the marine fuel oil composition. Optionally, one or more hydrotreated or non-hydrotreated biofuel fractions can be included in the marine fuel oil composition. Optionally, one or more additives can be included in the blend to form the marine fuel oil composition.

Conventionally, marine fuel oils are formed at least in part by using residual fractions. Due to the high sulfur content of many types of residual fractions, some type of additional processing and/or blending is often required to form low sulfur fuel oils (0.5 wt % or less sulfur) or ultra low sulfur fuel oils (0.1 wt % or less sulfur). Conventionally, blending with one or more low sulfur distillate fractions (such as hydrotreated distillate fractions) is typically used to adjust the sulfur content of the resulting blended fuel. Typical distillate blending components can correspond to, for example, fractions suitable for inclusion in an ultra low sulfur diesel pool. In addition to reducing the sulfur content of the resulting blended fuel, blending in a distillate fraction can also modify the viscosity, density, combustion quality (CCAI), pour point, and/or other properties of the fuel. Because having lower pour point and/or viscosity is often beneficial for improving the grade of the marine fuel oil, blending can often be preferable to performing severe hydrotreating on a resid fraction in order to meet a target sulfur level of 0.5 wt % or less.

Although conventional strategies for blending hydrotreated distillate fractions with resid fractions can be useful for achieving a desired fuel oil sulfur target, such conventional distillate fractions typically have a higher value for use (such as use as automotive diesel fuel) than the value of the resulting fuel oil or marine gas oil.

As an alternative to using a hydrotreated distillate fraction, at least a portion of such a hydrotreated distillate fraction can be replaced with a hydrotreated heavy atmospheric gas oil. The boiling range of the heavy hydrotreated heavy atmospheric gas oil can be relatively narrow, such as having a T10 distillation point of roughly 300° C. or more and a T90 distillation point of 440° C. or less.

A (hydrotreated) heavy atmospheric gas oil fraction with a T10 distillation point of 300° C. or more and a T90 distillation point of 440° C. or less can represent a challenging fraction to handle in a refinery. This is due in part to the nature of the boiling range. Typically, the preferred boiling range for a diesel fuel has a T95 distillation point and/or final boiling point around 650° F. (~343° C.). While heavier components can potentially be included in a diesel fuel fraction, including such heavier components can potentially degrade the cold flow properties and/or other properties of the diesel fuel. Unfortunately, the typical preferred boiling range for a lubricant base stock includes an initial boiling point or T5 boiling point of around 750° F. (~399° C.). Although lower boiling components can potentially be included in a lubricant, such lower boiling components can tend to reduce the viscosity and/or increase the volatility of a lubricant base stock. Due to this gap between the end of the desired boiling range for a diesel fuel and the start of the desired boiling range for a lubricant base stock, a distillate fraction that includes a substantial portion of components in the 343° C.-399° C. boiling range can be difficult to incorporate into a high value product.

One option could be to use a distillate fraction that includes a substantial portion of components in the 343° C.-399° C. boiling range as a feed to a cracking process, such as a steam cracking process. While this can be effective for forming naphtha fractions, such additional processing can be costly, and the resulting naphtha fractions are generated by substantially shortening the chain length of the feed. Alternatively, another option could be to try to upgrade such a distillate fraction to form a lubricant base stock. However, such upgrading would likely result in low yield of lubricant after additional costly processing. In particular, a distillate fraction containing a substantial portion of components in the 343° C.-399° C. boiling can typically have a kinematic viscosity that is too low to be desirable for use as a light neutral lubricant base stock. Additionally, even though the kinematic viscosity is low, such a distillate fraction can also typically have relatively poor cold flow properties. Still a further potential problem can be the sulfur content, which can be greater than 1000 wppm versus a typical desirable sulfur content for a lubricant of less than 75 wppm. Thus, forming a lubricant base stock from such a distillate fraction would not only require complex fractionation, but would also require significant hydrotreating for sulfur removal and/or dewaxing to achieve desirable cold flow properties. The combination of fractionation and additional processing would likely result in low yields of lubricant base stock. Based on the above difficulties for incorporating such a distillate fraction into a diesel fuel or lubricant product, it would be desirable to find a use for a distillate fraction including a substantial portion of 343° C.-399° C. boiling range components that does not require conversion to a significantly lower boiling range and/or that does not require substantial additional processing.

Instead of attempting to convert a heavy atmospheric gas oil fraction into a diesel fuel product and/or process the heavy atmospheric gas oil fraction to form a lubricant base stock, the fraction can be hydrotreated to reduce the sulfur content to between 0.05 wt % and 0.6 wt %, or 0.05 wt % to 0.5 wt %, or 0.1 wt % to 0.6 wt %, or 0.1 wt % and 0.5 wt %, or 0.3 wt % to 0.6 wt %, or 0.3 wt % to 0.5 wt %, or 0.5 wt % to 0.6 wt %. In some aspects, this level of hydrotreatment can be similar to the type of hydrotreatment that can be performed prior to introducing a feed into a fluid catalytic cracker. For example, the hydrotreating can be performed at relatively mild conditions in the presence of a conventional hydrotreating catalyst, such as a pressure of 1.0 MPa-g to 10.3 MPa-g (or 1.5 MPa-g to 5.5 MPa-g), a weighted average bed temperature of 250° C. to 380° C. (or 260° C. to 350° C.), and a liquid hourly space velocity of 0.1 $hr^{-1}$ to 5.0 $hr^{-1}$ (or 0.1 $hr^{-1}$ to 1.0 $hr^{-1}$). It is noted that the temperature at the inlet to the hydrotreating stage may be somewhat cooler than the average bed temperature. This mild hydrotreatment can optionally be performed using a lower purity $H_2$ stream, such as an $H_2$ stream containing 70 vol % to 100 vol % $H_2$ (or 75 vol % to 95 vol %). The hydrotreated effluent can then be fractionated to remove lower boiling products formed by during the hydrotreating process to produce a fraction with a T10 distillation point of 300° C. or more, or 310° C. or more, or 320° C. or more, and a T90 distillation point of 440° C. or less, or 430° C. or less.

In addition to a T10 to T90 boiling range and sulfur content, the hydrotreated heavy atmospheric gas oil can be characterized based on paraffin content, aromatics content pour point, cloud point, kinematic viscosity, and cetane index. Compositional values can be determined, for example, by gas chromatography, while pour point, cloud point, kinematic viscosity, and density at 15° C. can be determined according to typical ASTM methods gas oil fractions. For example, T10 and T90 distillation points can be determined according to ASTM D2887.

With regard to paraffin content, the hydrotreated heavy atmospheric gas oil can have a paraffin content 22% or more, or 25% or more, or 30 wt % or more. Additionally, roughly 40 wt % or more of the paraffins can correspond to n-paraffins, or 50% or more. Depending on the aspect, this can correspond to an n-paraffin content (relative to the weight of the hydrotreated heavy atmospheric gas oil) of 12% or more, or 14 wt % or more, or 17 wt % or more. Additionally or alternately, the aromatics content of the hydrotreated heavy atmospheric gas oil can be 45% or less, or 40% or less. Additionally or alternately, the distribution of paraffins in the hydrotreated heavy atmospheric gas oil can be relatively narrow, resulting in a wax end point that is closer than usual to the cloud point. The wax end point can be determined by Differential Scanning calorimetry. In various aspects, the wax end point can be 42° C. or less, or 40° C. or less. In addition to paraffins, the hydrotreated heavy atmospheric gas oil can include 30 wt % to 50 wt % of aromatics, or 33 wt % to 45 wt %.

Without being bound by any particular theory, it is believed that the high paraffin content and/or n-paraffin content, in combination with a relatively narrow boiling range and/or narrow range of types of paraffins, can result in an elevated cloud point as well as having a relatively similar pour point and cloud point. For example, the hydrotreated heavy atmospheric gas oil can have pour point of 15° C. or more, or 18° C. or more. Additionally or alternately, the cloud point can be 18° C. or more, or 21° C. or more, or 24° C. or more. In some aspects, the difference between the pour point and the cloud point can be 10° C. or less, or 5° C. or less.

With regard to kinematic viscosity, there are several options for characterizing a hydrotreated heavy atmospheric gas oil. One option can be to characterize the kinematic viscosity at temperature, such as a kinematic viscosity at 40° C. (KV40), a kinematic viscosity at 50° C. (KV50), or a kinematic viscosity at 100° C. (KV100). In various aspects, the KV40 value can be 10.5 cSt or more, or 11.5 cSt or more, or 12.5 cSt or more, such as up to 16 cSt or possibly still higher. In various aspects, the KV50 value can be 8.5 cSt to 11.5 cSt, or 9.0 cSt to 11.5 cSt, or 9.5 cSt to 11.5 cSt, or 8.5 cSt to 11.0 cSt, or 9.0 cSt to 11.0 cSt, or 9.5 cSt to 11.0 cSt. In various aspects, the KV100 value can be 2.8 cSt or more, or 3.0 cSt or more, such as up to 4.0 cSt or possibly still higher. Another option can be to characterize the temperature at which the hydrotreated heavy gas oil has a kinematic viscosity of 12 cSt, or 15 cSt. In various aspects, the hydrotreated heavy gas oil can have a kinematic viscosity of 12 cSt at 39° C.-45° C., or 41° C.-45° C. In various aspects, the gas oil can have a kinematic viscosity of 15 cSt at a temperature of 33° C. to 38° C., or 34° C. to 37° C. It is noted that the viscosity index of the hydrotreated heavy gas oil can be 80 or more, or 90 or more, such as up to 120 or possibly still higher. Additionally or alternately, the density at 15° C. for the hydrotreated heavy atmospheric gas oil can be 0.86 to 0.89 g/cm$^3$.

A marine fuel oil composition as described herein may be used a blendstock for forming marine fuel oils including 0.1 wt % or less of sulfur, or 0.5 wt % or less of sulfur, or 0.1 wt % to 0.5 wt % of sulfur. Where it is used as a blendstock, it may be blended with any of the following and any combination thereof to make an on-spec<0.1 wt % or <0.5 wt % sulfur finished fuel: low sulfur diesel (sulfur content of less than 500 ppmw), ultra low sulfur diesel (sulfur content<10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated natural fats or oils such as tall oil or vegetable oil, fatty acid methyl esters, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gasoil, non-hydrotreated coker vacuum gas oil, non-hydrotreated thermally cracked vacuum gas oil, non-hydrotreated thermally cracked diesel, non-hydrotreated thermally cracked gas oil, Group 1 slack waxes, lube oil aromatic extracts, deasphalted oil, atmospheric tower bottoms, vacuum tower bottoms, steam cracker tar, any residue materials derived from low sulfur crude slates, LSFO, RSFO, other LSFO/RSFO blendstocks. LSFO refers to low sulfur fuel oil, while RSFO refers to regular sulfur fuel oil.

A marine distillate fuel composition as described herein (also referred to as a marine gas oil composition) may be used a blendstock for forming marine distillate fuels including 0.1 wt % or less of sulfur, or 0.5 wt % or less of sulfur, or 0.1 wt % to 0.5 wt % of sulfur. Where it is used as a blendstock, it may be blended with any of the following and any combination thereof to make an on-spec<0.1 wt % or <0.5 wt % sulfur finished marine gas oil: low sulfur diesel (sulfur content of less than 500 ppmw), ultra low sulfur diesel (sulfur content<10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated natural fats or oils such as tall oil or vegetable oil, fatty acid methyl esters, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gasoil, non-hydrotreated coker vacuum gas oil, non-hydrotreated thermally cracked vacuum gas oil, non-hydrotreated thermally cracked diesel, non-hydrotreated thermally cracked gas oil, Group 1 slack waxes, lube oil aromatic extracts, deasphalted oil, atmospheric tower bottoms, vacuum tower bottoms, steam cracker tar, any residue materials derived from low sulfur crude slates, LSFO, RSFO, other LSFO/RSFO blendstocks.

Comparison of Heavy Hydrotreated Gas Oil with FCC Feed

Prior to performing fluid catalytic cracking (FCC) on a feedstock, a mild hydrotreating process can typically be performed on the feedstock. A typical FCC feedstock can correspond to a full range atmospheric gas oil. By contrast, the feedstock for forming a heavy hydrotreated atmospheric gas oil can have a narrower boiling range. The narrower boiling range can be achieved, for example, by fractionating a full range atmospheric gas oil prior to hydrotreating. Prior to hydrotreating, the atmospheric gas oil feed can have a T90 distillation point of 440° C. or less. Optionally but preferably, the T10 distillation point of the atmospheric gas oil prior to hydrotreating can be 250° C. or more, or 300° C. or more. After hydrotreating, the hydrotreated narrow atmospheric gas oil can have a T90 distillation point of 440° C. or less, or 430° C. or less. Additionally or alternately, the hydrotreated narrow atmospheric gas oil can have a final boiling point of 510° C. or less. This is in contrast to a conventional hydrotreated feedstock, which can typically have a T90 distillation point greater than 510° C., and can often have a final boiling point above 600° C.

Another contrast with a conventional FCC feed can be based on kinematic viscosity. Due in part to the wider boiling range, a conventional FCC feed can typically have a kinematic viscosity at 50° C. of 30 or more. By contrast, the hydrotreated narrow atmospheric gas oil can have a kinematic viscosity at 50° C. of 8.0 cSt to 10 cSt.

It is noted that the viscosity index of the hydrotreated narrow atmospheric gas oil can be 80 or more, or 90 or more. However, the pour point of the hydrotreated narrow atmospheric gas oil can typically be 18 or more, or 21 or more. Additionally, the sulfur content of the hydrotreated narrow atmospheric gas oil can be 0.05 wt % to 0.6 wt %, or 0.1 wt % to 0.5 wt %.

Other Components of the Composition

The components in a marine fuel oil composition or a marine distillate fuel composition other than the hydrotreated heavy atmospheric gas oil can be present in an amount of 85 vol % or less individually or in total, or 75 vol % or less, or 55 vol % or less, or 35 vol % or less, such as down to 15 vol % or possibly still lower.

Examples of such other components can include, but are not limited to, viscosity modifiers, pour point depressants, lubricity modifiers, antioxidants, and combinations thereof. Other examples of such other components can include, but are not limited to, distillate boiling range components such as straight-run atmospheric (fractionated) distillate streams, straight-run vacuum (fractionated) distillate streams, hydrocracked distillate streams, and the like, and combinations thereof. Such distillate boiling range components can behave as viscosity modifiers, as pour point depressants, as lubricity modifiers, as some combination thereof, or even in some other functional capacity in the aforementioned low sulfur marine bunker fuel.

Examples of pour point depressants can include, but are not limited to, oligomers/copolymers of ethylene and one or more comonomers (such as those commercially available from Infineum, e.g., of Linden, N.J.), which may optionally be modified post-polymerization to be at least partially functionalized (e.g., to exhibit oxygen-containing and/or nitrogen-containing functional groups not native to each respective comonomer). Depending upon the physicochemical nature of the marine fuel oil or marine distillate fuel, in some embodiments, the oligomers/copolymers can have a number average molecular weight ($M_n$) of about 500 g/mol or greater, for example about 750 g/mol or greater, about 1000 g/mol or greater, about 1500 g/mol or greater, about 2000 g/mol or greater, about 2500 g/mol or greater, about 3000 g/mol or greater, about 4000 g/mol or greater, about 5000 g/mol or greater, about 7500 g/mol or greater, or about 10000 g/mol or greater. Additionally or alternately in such embodiments, the oligomers/copolymers can have an $M_n$ of about 25000 g/mol or less, for example about 20000 g/mol or less, about 15000 g/mol or less, about 10000 g/mol or less, about 7500 g/mol or less, about 5000 g/mol or less, about 4000 g/mol or less, about 3000 g/mol or less, about 2500 g/mol or less, about 2000 g/mol or less, about 1500 g/mol or less, or about 1000 g/mol or less. The amount of pour point depressants, when desired, can include any amount effective to reduce the pour point to a desired level, such as within the general ranges described hereinabove.

In some embodiments, a marine fuel oil composition or marine distillate fuel composition can comprise up to 15 vol % (for example, up to 10 vol %, up to 7.5 vol %, or up to 5 vol %; additionally or alternately, at least about 1 vol %, for example at least about 3 vol %, at least about 5 vol %, at least about 7.5 vol %, or at least about 10 vol %) of slurry oil, fractionated (but otherwise untreated) crude oil, or a combination thereof.

Blending to Form Marine Fuel Oil and/or Marine Distillate Fuel

Tools and processes for blending fuel components are well known in the art. See, for example, U.S. Pat. Nos. 3,522,169, 4,601,303, 4,677,567. Once a hydrotreated heavy atmospheric gas oil has been formed and/or once a marine fuel oil composition or marine distillate fuel composition containing such a hydrotreated heavy atmospheric gas oil has been formed, such fractions or compositions can be blended as desired with any of a variety of additives including (e.g.) viscosity modifiers, pour point depressants, lubricity modifiers, antioxidants, and combinations thereof Examples of Blend Components A variety of blend components can be used to form marine gas oils and marine fuel oils. For marine gas oils, some suitable blend components for combination with a hydrotreated heavy atmospheric gas oil can be lower boiling, lower viscosity components. One example of a suitable blend component can be a naphtha splitter bottoms stream. A naphtha splitter bottoms stream can have, for example, an initial to final boiling range (or a T5 to T95 boiling range) of 150° C. to 200° C. This type of stream can have a sulfur content of less than 0.1 wt %, cloud point of −50° C. or less, and a pour point of −60° C. or less. The aromatics content of the naphtha splitter bottoms can be 20 wt % or more. However, the cetane index of such a stream can be less than 42 (or less than 40) and the kinematic viscosity at 40° C. can be less than 1.0 cSt. The flash point of a naphtha splitter bottoms can also be relatively low, such as a flash point of 50° C. or less, or 40° C. or less, such as down to 20° C. or possibly still lower. Based on these properties, a naphtha splitter bottoms stream can be unsuitable for use directly as a marine gas oil. However, such properties can provide a complement to the properties of a hydrotreated narrow atmospheric gas oil.

Another potential blend component can be a side stream or return stream from a naphtha reformer. During catalytic reforming, a heavier product stream can be formed that has a T10 distillation point of 200° C. or more and a T90 distillation point of 320° C. or less. Such a stream can primarily include aromatics that are heavier than desirable for inclusion in a gasoline pool. For example, such a stream can be a highly aromatic stream that contains 60 wt % or more aromatics, or 80 wt % or more aromatics. This can result in a low cetane index of 30 or less, or 25 or less. Such a stream can also have a cloud point of −20° C. or less and a pour point of −40° C. or less. Additionally, the kinematic viscosity at 40° C. for such a stream can be less than 2.0 cSt. However, even though a naphtha reformer return stream is too low in cetane index and/or viscosity to be suitable as a marine gas oil, such a stream can be a suitable component for blending with a hydrotreated heavy atmospheric gas oil when forming a marine gas oil.

Still another potential blending component can be a hydrocracked gas oil. A hydrocracked gas oil can correspond to a conventional blending component for forming various types of distillate fractions, including marine gas oils and/or fuel oils. However, a hydrocracked gas oil can often have alternative, higher value uses, so the ability to replace some or all of the hydrocracked gas oil in a blend with hydrotreated heavy atmospheric gas oil can be advantageous. It is noted that conventional marine gas oils can also be a suitable blending component. Depending on the nature of the hydrocracked gas oil, a hydrocracked gas oil can have a pour point of 0° C. to 15° C. and a cloud point of 3° C. to 18° C.

By blending streams such as naphtha splitter bottoms, catalytic reformer return streams, and/or hydrocracked gas oil with the hydrotreated heavy atmospheric gas oil, a blended product can be formed with the improved flow properties of the naphtha splitter and reformer streams, but with higher viscosity, higher cetane index, and lower volatility of the heavy atmospheric gas oil. As a result, three streams that are individually unsuitable as a marine gas oil can be combined to make a stream that can meet the kinematic viscosity, cetane index, and flash point specifications of a DMA or DMB marine gas oil under ISO 8217. Such a blended stream can have a kinematic viscosity at 40° C. of 2.0 cSt to 10.0 cSt, or 2.0 cSt to 6.0 cSt, or 6.0 cSt to 10 cSt. The blended stream can have other properties suitable for a marine gas oil, such as a cetane index of 45 or more, or 50 or more, such as up to 65 or possibly still higher; and a flash point of 80° C. or more, or 85° C. or more. Optionally, a portion of hydrocracked gas oil can also be included in such a blend, so that a combined amount of hydrotreated heavy atmospheric gas oil and hydrocracked gas oil corresponds to 70 wt % or more of the marine gas oil, or 80 wt % or more. Additionally, cold flow additives can be soluble in the blended stream, to allow for modification of pour point, cloud point, and/or cold filter plugging point.

Optionally, still other additional streams can also be incorporated into the marine gas oil, such as conventional marine gas oil streams, hydrotreated diesel or distillate streams, or other typical blend components that are used to form a marine gas oil.

In other aspects, a blend including a hydrotreated heavy atmospheric gas oil can correspond to a blend for forming a marine fuel oil. Optionally, the high cetane index of a hydrotreated heavy atmospheric gas oil can allow the hydrotreated heavy atmospheric gas oil to be used as a substitute for at least a portion of automotive diesel in a fuel oil blend. This can allow a high value blend component (automotive diesel) to be replaced with a lower value component while still forming a desired grade of fuel oil.

As an example, a potential blending component for forming a fuel oil can correspond to heavier products generated from a steam cracker processing train, such as a pre-cracker bottoms fraction separated from a crude feed prior to introduction into a steam cracker, or a steam cracker gas oil. In particular, a mixture of the pre-cracker bottoms and steam cracker gas oil can correspond to a suitable blend component for forming a fuel oil, when combined with a hydrotreated heavy atmospheric gas oil. The pre-cracker bottoms can roughly correspond to a type of vacuum resid fraction. The steam cracker gas oil can be beneficial for improving the ability of the final fuel oil to maintain solubility of asphaltenes. Without the steam cracker gas oil, the asphaltenes in a typical resid fraction could be susceptible to precipitation when mixing the resid with a heavy hydrotreated atmospheric gas oil. This is due in part to the relatively low $S_{BN}$ of a heavy hydrotreated atmospheric gas oil of 40 or less, or 37 or less, or 35 or less, and/or the relatively low BMCI of 30 to 40, or 30 to 37. As an example, a mixture of pre-cracker bottoms and steam cracker gas oil can be formed where at least 75 wt % of the mixture, or at least 85 wt %, corresponds to a combination of pre-cracker bottoms and steam cracker gas oil, and at least 45 wt % of the mixture corresponds to the pre-cracker bottoms, or at least 60 wt %. The balance of the mixture can correspond to various types of distillate fractions, such as low sulfur distillate fractions. The properties of such a mixture can vary depending on the crude used as the steam cracker feed, the relative amounts of pre-cracker bottoms and steam cracker gas oil, and the amount of additional distillate in the mixture. Table 1 shows an example of ranges for properties of some types blends of pre-cracker bottoms, steam cracker gas oil, and a minor amount of various distillates. Properties for a hydrotreated heavy atmospheric gas oil (HHAGO) and a marine gas oil are also shown for comparison.

More generally, the mixture can include a) a resid component (such as pre-cracker bottoms) that includes 3.0 wt % asphaltenes or more, or 4.0 wt % or more, or 5.0 wt % or more; b) a high solubility number component (such as a steam cracker gas oil) with an asphaltene content of 0.1 wt % or less, a $S_{BN}$ of 80 or more, or 90 or more, or 100 or more, and a BMCI of 80 or more, or 100 or more. The resulting mixture can have a BMCI of 45 or more, or 50 or more, or 55 or more.

TABLE 1

Properties of Steam Cracker Blend and Other Potential Blend Components

| Property | Steam Cracker Blend | HHAGO | MGO |
|---|---|---|---|
| Density @15° C. (g/mL) (D4052) | 0.938-0.973 | 0.882 | 0.854 |
| KV50 (cSt) (ISO 3104) | 14-215 | 9.7 | 3.6 |

TABLE 1-continued

| Properties of Steam Cracker Blend and Other Potential Blend Components | | | |
|---|---|---|---|
| Property | Steam Cracker Blend | HHAGO | MGO |
| Sulfur (wt %) (ISO 8754) | 1.5-1.9 | 0.45-0.50 | 0.014-0.046 |
| BMCI | 54-69 | 37 | 31 |
| Toluene Equivalence (TE) | 20-23 | 0 | 0 |
| Asphaltenes (wt %) (D6560) | 3.5-5.7 | 0 | 0 |
| TSP (wt %) | 0.01-0.02 | 0 | 0 |
| Estimated Cetane Number (IP 541) | 16-25 | 58 | 55 |
| CCAI (ISO 8217) | 816-851 | 799 | 800 |
| Total Acid Number (mg KOH/g) | 0.2-0.4 | <0.1 | <0.1 |
| Pour Point (° C.) (D97) | −3-0 | 21-24 | 6-9 |

As shown in Table 1, the ranges for the blends including the pre-cracker bottoms and the steam cracker gas oil have a relatively low cetane number, but a relatively low pour point and a high BMCI. Although the hydrotreated heavy gas oil has a higher pour point than a marine gas oil, for purposes of forming a fuel oil, the hydrotreated heavy gas oil can provide similar benefits to using marine gas oil or automotive diesel. It is noted that TSP refers to total sediment potential, according to ISO 10307-2. BMCI refers to the Bureau of Mines Correlation Index. A method of characterizing the solubility properties of a petroleum fraction can correspond to the toluene equivalence (TE) of a fraction, based on the toluene equivalence test as described, for example, in U.S. Pat. No. 5,871,634 (incorporated herein by reference with regard to the definition for toluene equivalence, solubility number ($S_{BN}$), and insolubility number (IN)). The calculated carbon aromaticity index (CCAI) can be determined according to ISO 8217.

The ranges of values shown for the blend including pre-cracker bottoms, steam cracker gas oil, and additional distillate were formed based on three different blend recipes (Blends A, B, and C) and using two different types of crude sources as the starting material for forming the pre-cracker bottoms and the steam cracker gas oil. In a first blend recipe, 70 wt % of pre-cracker bottoms were mixed with 23 wt % of steam cracker gas oil and 7 wt % of additional distillate. In a second blend recipe, 70 wt % of pre-cracker bottoms were mixed with 12 wt % of steam cracker gas oil and 18 wt % of additional distillate. In the third blend recipe, 48 wt % of pre-cracker bottoms were mixed with 28 wt % of steam cracker gas oil and 24 wt % of additional distillate.

When blending a heavy hydrotreated atmospheric gas oil with a steam cracker blend to form a marine fuel oil, properties of a marine fuel oil that can be characterized include, but are not limited to, kinematic viscosity (ISO 3104), and boiling range (D7169). For example, the kinematic viscosity at 50° C. can be 5 cSt to 300 cSt, or 5 cSt to 150 cSt, or 15 cSt to 300 cSt, or 15 cSt to 150 cSt, or 25 cSt to 300 cSt, or 25 cSt to 150 cSt. For example, the kinematic viscosity at 50° C. can be at least 10 cSt, or at least 15 cSt, or at least 25 cSt. It is noted that fuel oils with a kinematic viscosity at 50° C. of 15 cSt or higher can be beneficial, as such fuel oils typically do not require any cooling prior to use in order to be compatible with a marine engine. Additionally or alternately, the boiling range for the marine fuel oil can include a T50 distillation point of 320° C. or more, or 340° C. or more, or 360° C. or more, such as up to 550° C. or possibly still higher. Additionally or alternately, the boiling range for the marine fuel oil can include a T90 distillation point of 500° C. or more, or 550° C. or more, or 600° C. or more, such as up to 750° C. or possibly still higher. Additionally or alternately, the micro carbon residue of the marine fuel oil can be 5.0 wt % or less, or 4.0 wt % or less, such as down to 0.5 wt % or possibly still lower, as determined according to ISO 10370.

Examples of Blends to Form Marine Fuel Oils

The three types of steam cracker product blends (Blends A, B, and C) were each used to make four types of fuel oil compositions (Fuel Oils 1, 2, 3, and 4). Fuel oils 1 and 2 are similar in composition, but substitute hydrotreated heavy atmospheric gas (HHAGO) oil for marine gas oil (MGO). The recipe for Fuel Oils 1 and 2 is comparable to a recipe for forming a 180 cSt fuel oil. Fuel Oils 3 and 4 are related in a similar manner, but with recipes designed to maximize incorporation of hydrotreated heavy atmospheric gas oil or marine gas oil, respectively. It is noted that Fuel Oils 3 and 4 include a portion of both the HHAGO and the MGO. The recipes for Fuel Oils 1, 2, 3, and 4 can be viewed as "bookend" recipes that correspond to addition of roughly minimal and maximal amounts of hydrotreated heavy atmospheric gas oil/automotive diesel to the steam cracker product blends. Of course, other recipes could allow for addition of intermediate amounts. Table 2 shows the fuel oil blend recipes for Fuel Oils 1, 2, 3, and 4.

TABLE 2

| Fuel Oil Blends | | | | |
|---|---|---|---|---|
| | Blend 1 | Blend 2 | Blend 3 | Blend 4 |
| wt % | | | | |
| HHAGO | 16 | 0 | 67 | 21 |
| MGO | 0 | 12 | 9 | 64 |
| Steam Cracker Blend A, B, or C | 84 | 88 | 24 | 15 |

Based on using each of Blends A, B, and C to make Fuel Oil Blends 1, 2, 3, and 4, a total of 12 different fuel oil blends were formed. As shown in FIG. 1, for each of the 1A/1B, 2A/2B, and 3A/3B pairs, replacing the automotive diesel as a blend component with the hydrotreated heavy atmospheric gas oil results in a fuel oil with similar properties. Although the sulfur contents for the fuel oils corresponding to the 1A/1B, 2A/2B, and 3A/3B pairs are higher than 0.5 wt %, it is understood that additional low sulfur marine gas oil (or another convenient low sulfur blendstock) could be blended with these fuel oils to arrive at a 0.5 wt % or less fuel oil.

With regard to pairs 1C/1D, 2C/2D, and 3C/3D, once again the ability to replace the automotive diesel with hydrotreated heavy atmospheric gas oil is demonstrated. Due to the lower sulfur content of the MGO, the 1D, 2D, and 3D fuel oils have a corresponding lower sulfur content. However, fuel oil blends 1C, 2C, and 3C have an advantage of a higher kinematic viscosity at 50° C., based on the higher kinematic viscosity of the hydrotreated heavy atmospheric gas oil.

The data in FIG. 1 show that fuel oils can be formed using a variety of blend recipes that involve a hydrotreated heavy atmospheric gas oil, with amounts of the hydrotreated heavy atmospheric gas oil ranging from 10 wt % to 70 wt % of the fuel oil product.

Examples of Blends to Form Marine Distillate Fuels

FIG. 2 provides details for several potential blending components for forming a marine gas oil. Column 3 corresponds to a hydrotreated heavy atmospheric gas oil (HHAGO). Column 4 is a distillate fraction that corresponds to a naphtha splitter bottoms fraction (NSB). Column 5 is a distillate fraction that corresponds to a return stream from a catalytic naphtha reformer (CNR). These are examples of low sulfur distillate fractions that can be beneficial for improving the cold flow properties of a marine gas oil blend that also includes a hydrotreated heavy atmospheric gas oil. Column 6 corresponds to a hydrocracked gas oil (HCGO), which is a typical type of blend component for use in forming a marine gas oil. Column 7 corresponds to a conventional marine gas oil (MGO).

The blending components shown in FIG. 2 were used to form various blends corresponding to potential marine gas oils. Table 3 shows the blend recipes for six potential marine gas oils. Most of the blends in Table 3 correspond to blends where substantial amounts of hydrotreated heavy atmospheric gas oil are used in the recipe. It is noted that the blend recipe for MGO 3 corresponds to addition of small amounts of the naphtha splitter stream and the catalytic reformer return stream to a conventional marine gas oil.

TABLE 3

Marine Gas Oil Blends - Percentage of Blend Components (wt %)

| | MGO 1 | MGO 2 | MGO 3 | MGO 4 | MGO 5 | MGO 6 |
|---|---|---|---|---|---|---|
| HHAGO | 60% | 60% | | 30% | 30% | 40% |
| Distillate 1 (NSB) | 10% | | 10% | 9% | | 10% |
| Distillate 2 (NCR) | 5% | | 5% | 5% | | 5% |
| HCGO | 25% | 40% | | 56% | 70% | 45% |
| MGO | | | 85% | | | |
| KV @ 40° C. (D445) (cSt) | 6.3 | 9.4 | 3.5 | 5.6 | 7.9 | 5.8 |
| MGO grade | DMB | DMB | DMA | DMA | DMB | DMA |

As shown in Table 3, based on the kinematic viscosity at 40° C. of the resulting blends, MGO 1, MGO 2, and MGO 5 correspond to potential DMB marine gas oils, while blends MGO 3, MGO 4, and MGO 6 correspond to potential DMA marine gas oils.

FIG. 3 shows additional analysis of MGO 1, MGO 2, and MGO 3. FIG. 3 also shows analysis for the conventional marine gas oil used to form MGO 3. Additionally, the final column in FIG. 3 includes the specifications for a DMA marine gas oil under ISO 8217.

As shown in FIG. 3, MGO 1 and MGO 2 have higher kinematic viscosities than MGO 3, based on the relatively high kinematic viscosity of the hydrotreated heavy atmospheric gas oil used to form MGO 1 and MGO 2. MGO 1 and MGO 2 also have a higher pour point than MGO 3. However, the cetane index, flash point, acid number, and carbon residue are similar to MGO 3, and comparable to the conventional marine gas oil and/or within the specifications of ISO 8217. Based on additional characterization, MGO 1 and MGO 2 are also comparable to the conventional marine gas oil and/or within specification under ISO 8217 with regard to a) insolubles as determined according to ASTM D4625; b) thermal stability under ASTM D6468; and filter blocking tendency under ASTM D2068.

FIG. 3 also provides cloud points for MGO 1 (19° C.), MGO 2 (19° C.), and MGO 3 (5° C.). Cloud point values according to D2500/D5771 were also obtained for the other MGO blends shown in Table 3. MGO 4 had a cloud point of 17° C., MGO 5 had a cloud point of 18° C., and MGO 6 had a cloud point of 15° C.

The data values in FIG. 3 show that blends formed using a substantial portion of hydrotreated heavy gas oil are potentially suitable for use as marine gas oils. Although the hydrotreated heavy gas oil is a relatively high viscosity and high boiling blend component, blends formed using the hydrotreated heavy atmospheric gas oil can have values within specification for cetane index while also having sufficient stability and sufficiently low values for various types of residue and insolubles. However, improvement of cold flow properties would be beneficial. It has been unexpectedly discovered that blending hydrotreated heavy gas oil with lighter fractions, such as naphtha splitter bottoms and/or catalytic reformer return streams, can allow cold flow additives to be soluble in the resulting blend. The ability to add cold flow additives can potentially provide sufficient improvements in cold flow properties to allow use of various types of blends as marine gas oils.

Table 4 shows a comparison of the pour points for each MGO 1-MGO 6, along with pour point values after addition of a commercially available cold flow additive. Several different amounts of cold flow additive were investigated, as shown in Table 4. The values in Table 4 were mostly determined according to ASTM D5950, with the exception of the values indicated by a "*". Those values were determined using ASTM D97, which was believed to be comparable to ASTM D5950 for the identified values. It is noted that multiple values were obtained for some blends.

TABLE 4

Pour Point Comparison (° C.) with Cold Flow Additive

| Amt of Pour Point Additive | MGO 1 | MGO 2 | MGO 3 | MGO 4 | MGO 5 | MGO 6 |
|---|---|---|---|---|---|---|
| 0 wppm | 12.0 | 13.0 | −6.0 | 12.0 | 16 | 16 |
| 400 wppm | | | | −27 | | |
| 500 wppm | −24 | −24 | −24 | | −10 | −24 |
| 800 wppm | −27 | −28 | | −30 | −25 | −24 |

As shown in Table 4, the blend corresponding to MGO 3 (primarily commercial marine gas oil, no hydrotreated heavy atmospheric gas oil) had a pour point of −6.0° C. without the use of a pour point additive. This is in contrast to the other blends, where the presence of 30% or more of the hydrotreated heavy atmospheric gas oil resulted in a pour point of 12° C. or more. After addition of the commercially available cold flow additive, the MGO blends including the hydrotreated heavy atmospheric gas oil had comparable pour points to the pour point of MGO 3.

As noted above, pour point additives and/or other cold flow improvers have poor solubility in the hydrotreated heavy atmospheric gas oil prior to blending. However, by blending the hydrotreated heavy atmospheric gas oil with hydrocracked gas oil, naphtha splitter bottoms, and/or catalytic naphtha return stream, the resulting blend can have sufficient solvating ability to dissolve conventional pour point additives. Additionally, as shown by the results in Table 4, it was unexpectedly found that addition of pour point additives to blends including hydrotreated atmospheric gas oil resulted in pour points comparable to the pour point achieved when starting with a blend including primarily marine gas oil. This is unexpected due to the large difference in pour points between the blends including the hydrotreated heavy atmospheric gas oil and MGO 3, which primarily included a conventional marine gas oil.

The impact of the commercially available cold flow additive on cold filter plugging point (CFPP) was also investigated for the MGO 1 and MGO 2 blends. Due to the high values for the CFPP temperature, the test was performed according to the manual mode of D6371. The results are shown in Table 5.

TABLE 5

| CFPP Comparison (° C.) with Cold Flow Additive | | |
|---|---|---|
| Amt of Pour Point Additive | MGO 1 | MGO |
| 0 wppm | 17 | 19 |
| 500 wppm | 11 | 15 |
| 800 wppm | 8 | 12 |

As shown in Table 5, addition of the cold flow additive was effective for substantially reducing the cold filter plugging point, even though the starting value (without additive) of the cold filter plugging point was somewhat high.

ADDITIONAL EMBODIMENTS

Embodiment 1

A hydrotreated atmospheric gas oil composition comprising a T10 distillation point of 300° C. or more, a T90 distillation point of 440° C. or less, a sulfur content of 0.03 wt % to 0.6 wt %, a $S_{BN}$ of 40 or less, a pour point of 15° C. or more, a difference between the pour point and a cloud point being 10° C. or less, and a kinematic viscosity at 40° C. of 10.5 cSt to 16 cSt.

Embodiment 2

The composition of Embodiment 1, wherein the composition further comprises a wax end point of 30° C. to 45° C. (or 32° C. to 42° C.).

Embodiment 3

The composition of any of the above embodiments, wherein the composition comprises a viscosity index of 80 or more (or 90 or more).

Embodiment 4

The composition of any of the above embodiments, wherein the composition comprises a cetane index of 50 or more (or 60 or more).

Embodiment 5

The composition of any of the above embodiments, wherein the composition comprises a sulfur content of 0.1 wt % or more; or wherein the composition comprises a sulfur content of 0.4 wt % or less; or wherein the composition comprises 0.05 wt % or less of micro carbon residue; or a combination thereof.

Embodiment 6

The composition of any of the above embodiments, wherein the composition comprises a paraffins content of 22 wt % or more (or 30 wt % or more); or wherein 40 wt % or more of the paraffins comprise n-paraffins; or a combination thereof.

Embodiment 7

The composition of any of the above embodiments, wherein the difference between the pour point and the cloud point is 5° C. or less.

Embodiment 8

The composition of any of the above embodiments, wherein the composition comprises a kinematic viscosity at 40° C. of 14 cSt or less, or wherein the composition comprises a kinematic viscosity at 50° C. of 11.5 cSt or less, or a combination thereof.

Embodiment 9

The composition of any of the above embodiments, wherein the composition comprises a density at 15° C. of 0.86 to 0.89 g/cm$^3$.

Embodiment 10

The composition of any of the above embodiments, wherein the composition comprises a calculated carbon aromaticity index of 790 to 810, or wherein the composition comprises 30 wt % to 50 wt % aromatics (or 33 wt % to 45 wt %), or a combination thereof.

Embodiment 11

The composition of any of the above embodiments, wherein the composition comprises a $S_{BN}$ of 37 or less (or 35 or less); or wherein the composition comprises a BMCI of 40 or less (or 37 or less); or a combination thereof.

Embodiment 12

The composition of any of the above embodiments, wherein the composition comprises a sulfur content of 0.3 wt % to 0.5 wt %.

Embodiment 13

The composition of any of the above embodiments, wherein the composition comprises a low sulfur fuel oil.

Embodiment 14

The composition of any of Embodiments 1-13, wherein the composition comprises a sulfur content of 0.5 wt % to 0.6 wt %, the composition optionally comprising a low sulfur fuel oil blendstock.

The above examples are strictly exemplary, and should not be construed to limit the scope or understanding of the present invention. It should be understood by those skilled in the art that various changes may be made and equivalents may be substituted without departing from the true spirit and scope of the Invention. In addition, many modifications may be made to adapt a particular situation, material, composition of matter, process, process step or steps, to the objective, spirit and scope of the described invention. All such modifications are intended to be within the scope of the claims appended hereto. It must also be noted that as used herein and in the appended claims, the singular forms "a," "an," and "the" include plural referents unless the context clearly dictates otherwise. Each technical and scientific term used herein has the same meaning each time it is used. The use of "or" in a listing of two or more items indicates that any combination of the items is contemplated, for example, "A or B" indicates that A alone, B alone, or both A and B are intended. The publications discussed herein are provided solely for their disclosure prior to the filing date of the present application. Nothing herein is to be construed as an admission that the described invention is not entitled to antedate such publication by virtue of prior invention. Further, the dates of publication provided may be different from the actual publication dates which may need to be confirmed independently.

The invention claimed is:

1. A hydrotreated atmospheric gas oil composition comprising a T10 distillation point of 300° C. or more, a T90 distillation point of 440° C. or less, a sulfur content of 0.03 wt % to 0.6 wt %, a SBN of 40 or less, a pour point of 15° C. or more, a difference between the pour point and a cloud point being 10° C. or less, and a kinematic viscosity at 40° C. of 10.5 cSt to 16 cSt.

2. The composition of claim 1, wherein the composition further comprises a wax end point of 30° C. to 45° C.

3. The composition of claim 1, wherein the composition comprises a viscosity index of 80 or more.

4. The composition of claim 1, wherein the composition comprises 0.05 wt % or less of micro carbon residue.

5. The composition of claim 1, wherein the composition comprises a cetane index of 50 or more.

6. The composition of claim 1, wherein the composition comprises a sulfur content of 0.1 wt % or more; or wherein the composition comprises a sulfur content of 0.4 wt % or less; or a combination thereof.

7. The composition of claim 1, wherein the composition comprises a paraffins content of 22 wt % or more.

8. The composition of claim 7, wherein 40 wt % or more of the paraffins comprise n-paraffins.

9. The composition of claim 1, wherein the difference between the pour point and the cloud point is 5° C. or less.

10. The composition of claim 1, wherein the composition comprises a kinematic viscosity at 40° C. is 14 cSt or less.

11. The composition of claim 1, wherein the composition comprises a kinematic viscosity at 50° C. of 11.5 cSt or less.

12. The composition of claim 1, wherein the composition comprises a density at 15° C. of 0.86 to 0.89 g/cm$^3$.

13. The composition of claim 1, wherein the composition comprises a calculated carbon aromaticity index of 790 to 810.

14. The composition of claim 1, wherein the composition comprises 30 wt % to 50 wt % aromatics.

15. The composition of claim 1, wherein the composition comprises a SBN of 37 or less.

16. The composition of claim 1, wherein the composition comprises a BMCI of 40 or less.

17. The composition of claim 1, wherein the composition comprises a sulfur content of 0.3 wt % to 0.5 wt %.

18. The composition of claim 1, wherein the composition comprises a low sulfur fuel oil.

19. The composition of claim 1, wherein the composition comprises a sulfur content of 0.5 wt % to 0.6 wt %.

20. The composition of claim 19, wherein the composition comprises a low sulfur fuel oil blendstock.

* * * * *